US006532622B2

(12) United States Patent
Seon et al.

(10) Patent No.: US 6,532,622 B2
(45) Date of Patent: Mar. 18, 2003

(54) BRUSH HEAD OF VACUUM CLEANER

(75) Inventors: Chang-Woo Seon, Incheon (KR); Sang-Bo Kang, Incheon (KR)

(73) Assignee: Daewoo Electronics Co., Ltd., Seoul (KR)

( * ) Notice: Subject to any disclaimer, the term of this patent is extended or adjusted under 35 U.S.C. 154(b) by 0 days.

(21) Appl. No.: 09/774,507

(22) Filed: Jan. 31, 2001

(65) Prior Publication Data

US 2001/0042285 A1 Nov. 22, 2001

(30) Foreign Application Priority Data

May 17, 2000 (KR) ..... P 2000-13962
May 18, 2000 (KR) ..... U 2000-26723

(51) Int. Cl.[7] ..... A47L 9/02
(52) U.S. Cl. ..... 15/415.1; 15/411; 285/7
(58) Field of Search ..... 15/411, 415.1; 285/7, 184, 185, 223, 283

(56) References Cited

U.S. PATENT DOCUMENTS 1,072,607 A * 9/1913 Guthorn ..... 15/411
1,086,367 A * 2/1914 Hope ..... 15/411
1,161,908 A * 11/1915 Tice ..... 15/411
2,038,697 A * 4/1936 Winslow ..... 15/411
2,170,963 A * 8/1939 Dahl ..... 15/411
2,203,088 A * 6/1940 Hansson ..... 15/415.1
2,246,438 A * 6/1941 Hedlund ..... 285/7
2,710,204 A * 6/1955 Faith-Ell ..... 285/7
2,974,347 A * 3/1961 Seyfried ..... 15/411
4,521,936 A * 6/1985 Medwed ..... 285/7
4,537,424 A 8/1985 Maier et al. ..... 285/7
6,065,183 A * 5/2000 Hammeken et al. ..... 15/415.1
6,345,408 B1 * 2/2002 Nagai et al. ..... 15/415.1

* cited by examiner

*Primary Examiner*—Theresa T. Snider
(74) *Attorney, Agent, or Firm*—Harness, Dickey & Pierce, P.L.C.

(57) ABSTRACT

A brush head of a vacuum cleaner can pivot in a horizontal direction as well as a vertical direction with respect to a suction pipe, so as to easily clean an area narrower than the width of the brush head. The brush head of a vacuum cleaner includes a body which is detachably coupled to a suction pipe and is formed with a suction hole for sucking dust. A hollow cylindrical pivoting part is integrally formed with the body at a rear central portion of the body and is formed with a roller receiving cut along a periphery of the lower surface of the pivoting part. A cylindrical pivot supporting member is inserted into the pivoting part to support a horizontal pivoting movement of the pivoting part. The pivot supporting member is formed with a communicating space at its peripheral wall which communicates with the suction hole and the suction pipe, and is provided with a roller at its rear bottom surface. And, a pair of elastic bands are mounted to support the connection between the pivoting part and the pivot supporting member. One end of each elastic band is caught on the pivot supporting member and the other end of each elastic band is caught on the body. The elastic bands are disposed symmetrically on both sides of the body.

15 Claims, 8 Drawing Sheets

BRUSH HEAD OF VACUUM CLEANER

BACKGROUND OF THE INVENTION

1. Field of the Invention

The present invention relates to a vacuum cleaner, and more particularly, to a brush head of a vacuum cleaner which can pivot in a horizontal direction as well as a vertical direction with respect to a suction pipe.

2. Description of the Related Art

Generally, a vacuum cleaner is an apparatus to suck and collect dust or dirt by means of a negative pressure caused by an operation of a vacuum pump, thereby cleaning a floor, etc. The vacuum cleaner includes a suction pipe which is detachably connected with a front end of a flexible hose mounted to a main body, and a brush head which is detachably coupled with a front end of the suction pipe.

Such a brush head sucks and removes dirt on a floor by means of a roller brush, etc. mounted thereinside, and increases a suction area so as to perform efficiently a cleaning process.

An illustrative brush head of a vacuum cleaner is disclosed in U.S. Pat. No. 4,537,424, issued Aug. 27, 1985, which will be described herein with reference to FIG. 1.

As shown in FIG. 1, a conventional brush head 1 of a vacuum cleaner comprises a shell-shaped joint pan 3 which is mounted to a rear portion of a brush head body 2, and a hollow cylindrical joint head 4 which is rotatably mounted in the joint pan 3 while contacting with the inner surface of the joint pan 3. That is, an axis which extends in the longitudinal direction of the joint head is parallel with the floor surface. And, bores 6 are perforated at central portions of discs 5 which are respectively coupled to both opened sides of the joint head 4.

Also, a front end of a receiving part 8, into which the suction pipe 7 is detachably inserted, penetrates a side surface of the joint head 4 to extend thereinside, and is formed with a bore (not shown) in alignment with the bores 6 of the discs 5.

In addition, a pivot shaft (not shown) is inserted into the bores 6 of the discs 5 coupled to the joint head 4 and the bore of the receiving part 8 receiving the suction pipe 7, so that the brush head body 2 can pivot in a vertical direction about the pivot shaft with respect to the suction pipe 7.

As a result, since the brush head 1 is mounted pivotably in a vertical direction with respect to the suction pipe 7, the bottom surface of the brush head 1 always contacts closely with the floor regardless of a tilting angle of the suction pipe 7 with respect to the floor.

However, in the conventional brush head of a vacuum cleaner structured as above, the brush head 1 is fixed to the suction pipe 7 by forming somewhat of a "T" shape, and is unable to pivot in a horizontal direction. Accordingly, the conventional brush head 1 cleans effectively only a broad floor without any obstacles thereon, however, the brush head 1 can not clean an area, e.g. a space between a furniture and a wall, narrower than the width of the brush head 1, because the brush head 1 can not be inserted thereinto.

SUMMARY OF THE INVENTION

It is an object of the present invention to provide a brush head of a vacuum cleaner which can pivot in a horizontal direction as well as a vertical direction with respect to a suction pipe, so as to easily clean an area narrower than the width of the brush head.

In order to achieve the above object, the present invention provides a brush head of a vacuum cleaner comprising a body which is detachably coupled to a suction pipe and is formed with a suction hole for sucking dust; a fixing means, one end of which is detachably coupled to the suction pipe; a pivoting means, one end of which is fixedly coupled to the body and the other end of which is coupled to the other end of the fixing means pivotably in a horizontal direction, the pivoting means pivoting together with the body; and a coupling means which is mounted to the fixing means and the pivoting means to support securely the connection therebetween.

According to an embodiment of the present invention, the fixing means is implemented as a cylindrical pivot supporting member, one end of which is detachably coupled to the suction pipe, the pivoting means is implemented as a hollow cylindrical pivoting part which is integrally formed with the body at a rear central portion of the body and into which the pivot supporting member is inserted, the pivoting part pivoting in a horizontal direction with respect to the pivot supporting member, and the coupling means is implemented as a pair of elastic members, one end of each elastic member is caught on the pivot supporting member and the other end of each elastic member is caught on the body, the pair of elastic members being disposed symmetrically on both sides of the body.

The pivot supporting member is formed with a communicating space at its peripheral wall, which communicates with the suction hole and the suction pipe, and is provided with a roller at its rear bottom surface. A supporting shaft which is inserted into the pivot supporting member to support the pivoting movement of the pivoting part protrudes upward from a central portion of a lower surface of the pivoting part. And, a roller receiving cut which receives the roller is formed along a periphery of the lower surface of the pivoting part, through which the roller can contact continuously with a floor.

Preferably, the roller receiving cut is formed at the circumferential angle of 180° at the rear bottom surface of the pivoting part.

A fixing pin is perpendicularly inserted in the pivot supporting member at a front upper portion thereof, the upper end of the fixing pin being exposed outside so that one end of each elastic member is caught thereon together, and a pair of column-shaped supporting protuberances protrude upward symmetrically at the body, adjacently to each lateral end of the body, on which the other end of each elastic member is caught respectively.

Preferably, the elastic member is an elastic band which is made from a silicon resin material.

Between the suction pipe and the pivot supporting member provided is a connecting member, one end of which is detachably coupled to the suction pipe and the other end of which is hingedly coupled to the pivot supporting member. The connecting member is provided with a pair of pivot shafts which protrude from both sides of the connecting member respectively so that the body can pivot in a vertical direction with respect to the suction pipe.

And, a cover is coupled to the upper portion of the pivoting part for shielding the pivot supporting member, and the cover is formed with a vertical cut at its rear portion through which the connecting member passes, thereby the body pivoting in a vertical direction with respect to the suction pipe.

According to another embodiment of the present invention, the pivoting means is implemented as a pivoting coupler which is coupled to the body pivotably in a vertical direction at a rear central portion of the body, the fixing means is implemented as a fixing coupler, one end of which is detachably coupled to the suction pipe and the other end of which is coupled to the pivoting coupler, and the coupling means is implemented as a hinge screw which is fastened to the pivoting and fixing couplers so that the pivoting coupler can pivot in a horizontal direction with respect to the fixing coupler.

One end of the pivoting coupler is disposed inside the body and is formed with a curved vertical pivoting part so that the body can pivot in a vertical direction, the other end of the pivoting coupler is disposed at a rear central portion of the body and is formed with a circular first air hole which communicates with the suction hole, and a hollow female holder is disposed inside the first air hole and protrudes upward from the central portion of a bottom surface of the pivoting coupler.

The fixing coupler includes a circular second air hole which is of equal size and formed opposed to the first air hole, the second air hole communicating with the suction pipe, a pivot supporting part which is disposed lower than the second air hole and received in the first air hole when the fixing coupler is coupled to the pivoting coupler, and a male holder which protrudes downward from an upper surface of the pivot supporting part and is inserted into the hollow female holder formed in the first air hole, the male holder being formed with a screw hole thereinside in a longitudinal direction.

And, the hinge screw penetrates the bottom surface of the pivoting coupler and is fastened into the screw hole of the male holder which is inserted into the female holder.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
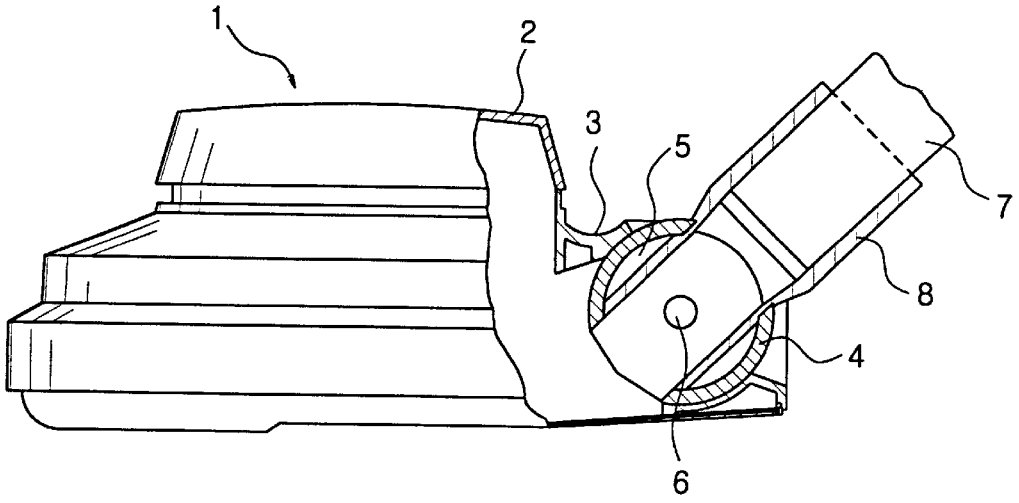
FIG. 1 (PRIOR ART)
FIG. 1 is a partially sectional view showing a conventional brush head of a vacuum cleaner.
Figure 2:
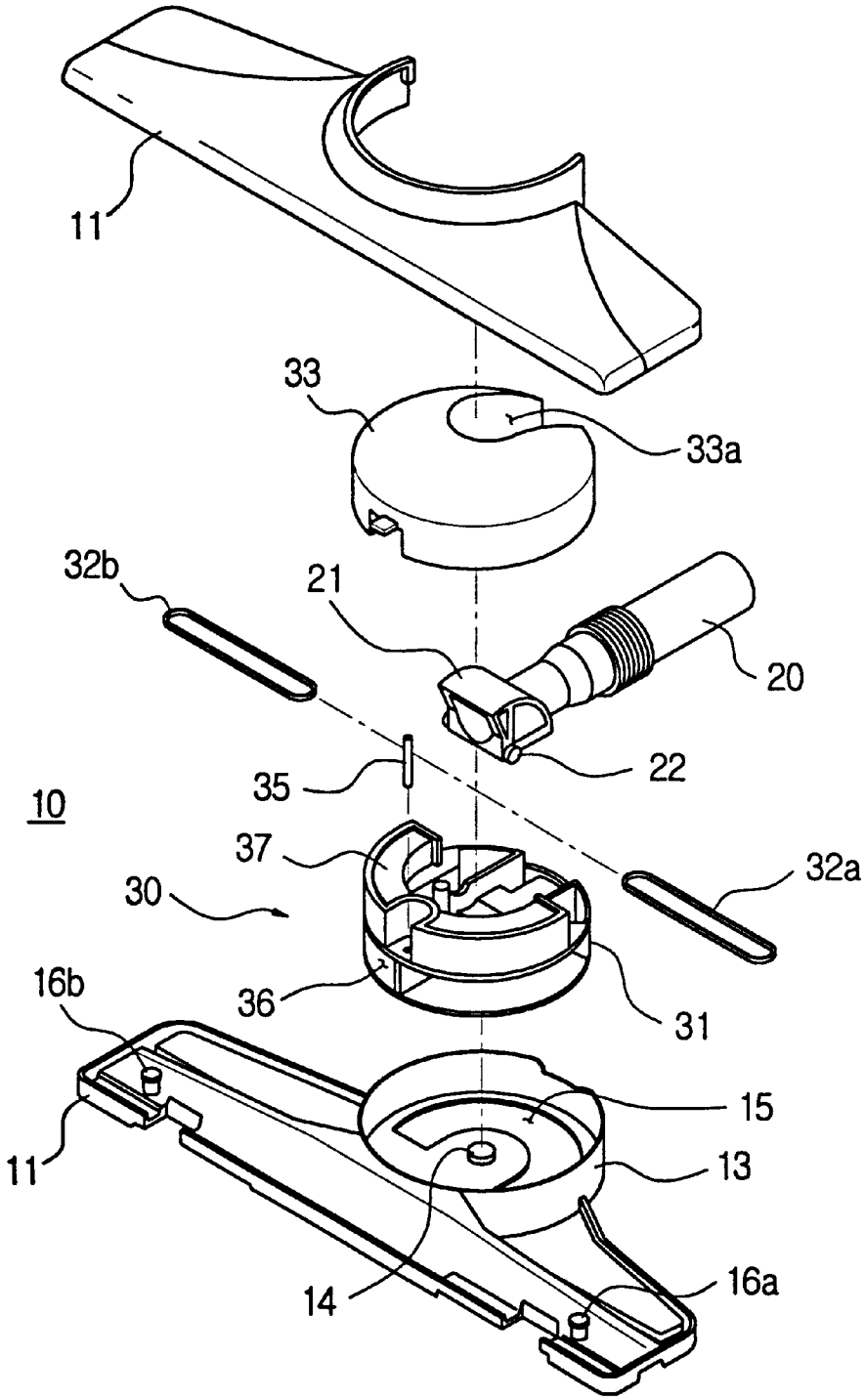
FIG. 2 is an exploded perspective view showing a brush head of a vacuum cleaner according to a preferred embodiment of the present invention.
Figure 3:
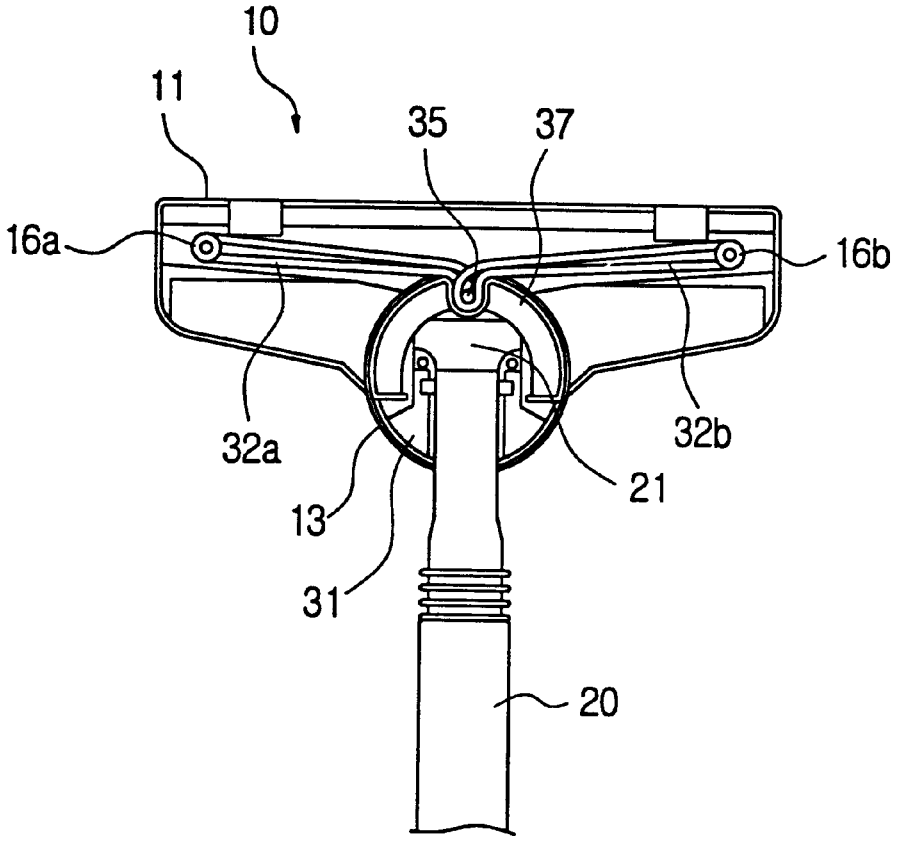
FIG. 3 is a plan view showing an inner structure of the brush head depicted in FIG. 2.
Figure 4:
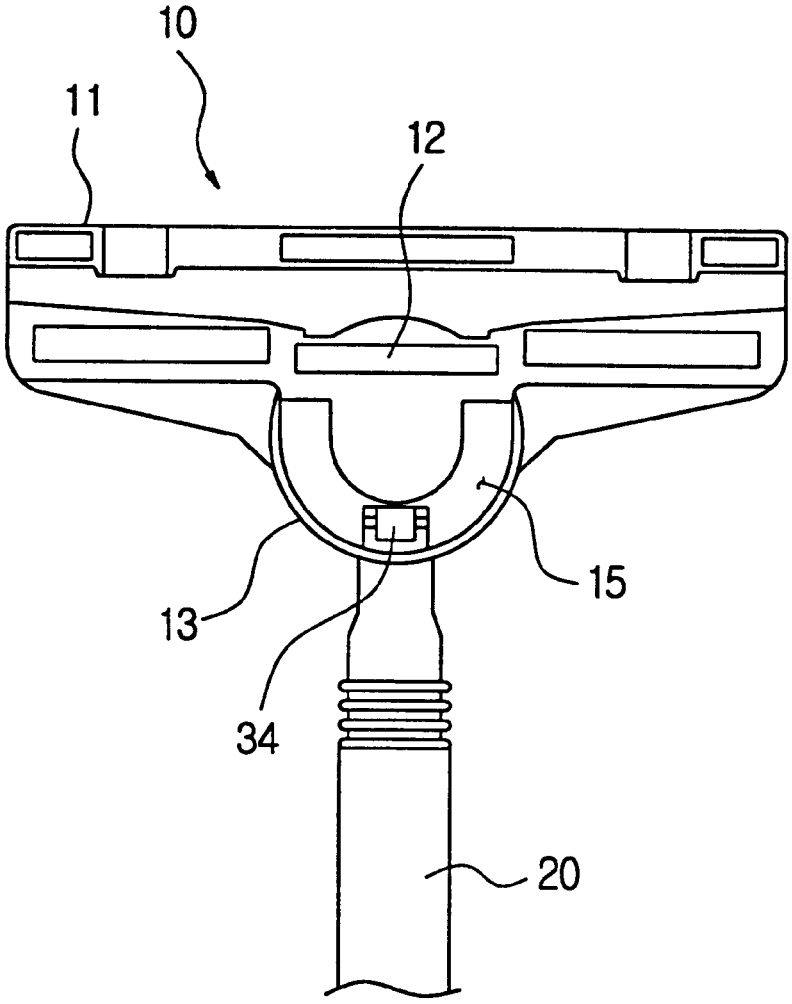
FIG. 4 is a bottom view of the brush head depicted in FIG. 2.

FIG. 2 is an exploded perspective view showing a brush head of a vacuum cleaner according to a preferred embodiment of the present invention, FIG. 3 is a plan view showing an inner structure of the brush head depicted in FIG. 2, and FIG. 4 is a bottom view of the brush head.

As shown in these drawings, a brush head 10 of a vacuum cleaner according to a preferred embodiment of the present invention comprises a body 11 forming an outer appearance, which is detachably coupled to a front end of a suction pipe 20 and is divided into an upper part and a lower part, a brush (not shown) which is mounted to the body 11, and a pivoting device 30 which enables the brush head 10 to pivot in a horizontal direction with respect to the suction pipe 20.

At a bottom surface of the brush head body 11, a suction hole 12 for sucking dust or dirt is formed.

The pivoting device 30 includes a pivoting means that is implemented as a hollow cylindrical pivoting part 13 which is integrally formed with the body 11 at a rear central portion of the body 11 and communicates with the suction hole 12, a fixing means that is implemented as a pivot supporting member 31 which supports the pivoting movement of the pivoting part 13 of the brush head body 11, and a coupling means that is implemented as elastic members 32*a* and 32*b* which elastically support the connection between the brush head body 11 and the pivot supporting member 31. The pivoting part 13 pivots horizontally with respect to the pivot supporting member 31, which will be described later.

The pivoting device 30 further includes a cover 33 which shields the upper portion of the pivot supporting member 31.

Describing more in detail, a supporting shaft 14 which is inserted into the pivot supporting member 31 to support the pivoting movement of the pivoting part 13 protrudes upward from a central portion of a lower surface of the pivoting part 13. And, a roller receiving cut 15 which receives a roller 34 is formed along a periphery of the lower surface of the pivoting part 13. The roller 34 can contact continuously with the floor through the roller receiving cut 15, even when the brush head body 11 pivots to the left or right. Preferably, the roller receiving cut 15 is formed at the circumferential angle of 180° at a rear bottom surface of the pivoting part 13.

The cylindrical pivot supporting member 31 is coupled with a connecting member 21 at its upper portion, the connecting member 21 being detachably coupled to the suction pipe 20. A fixing pin 35, which will be described later, is perpendicularly inserted in the pivot supporting member 31 at its front upper portion, the upper end of the fixing pin 35 being exposed outside. And, the pivot supporting member 31 is formed with a communicating space 36 at its lower peripheral wall, which communicates with the suction hole 12 of the body 11 for guiding dirt sucked through the suction hole 12 toward the suction pipe 20, and is provided with the roller 34 (see FIG. 4) at its rear bottom surface, which is disposed in the roller receiving cut 15 of the pivoting part 13 for enabling the brush head body 11 to move smoothly. In addition, a pair of pivot shafts 22 protrude from both sides of the connecting member 21 respectively so that the brush head body 11 can pivot in a vertical direction with respect to the connecting member 21 and/or the suction pipe 20.

The cover 33, which is coupled to the upper portion of the pivoting part 13 and shields the pivot supporting member 31, is formed with a vertical cut 33*a* at its rear portion, through which the connecting member 21 passes, thereby the brush head body 11 pivoting in a vertical direction with respect to the suction pipe 20.

Also, at the brush head body 11 and the pivot supporting member 31 provided are the pair of elastic members 32*a* and 32*b* which elastically support the connection between the brush head body 11 and the pivot supporting member 31. For this, a pair of column-shaped supporting protuberances 16*a* and 16*b* protrude upward symmetrically with each other at the body 11, adjacently to each lateral end of the body 11.

Preferably, the elastic members 32*a* and 32*b* are implemented as bands made from an elastic material. Especially, the elastic bands 32*a* and 32*b* are made from a silicon resin, thereby enhancing the elasticity and durability even when the bands 32*a* and 32*b* are used for a long term.

Describing more in detail, one end of each elastic band 32*a* and 32*b* is caught on the fixing pin 35 which is inserted in the pivot supporting member 31, and the other end of each elastic band 32*a* and 32*b* is caught on each supporting protuberance 16*a* and 16*b*, respectively. By this structure, after the brush head 10 is used while pivoting to the left or right, the brush head 10 can return to its original position swiftly and accurately by means of an elastic restoring force of the elastic band 32*a* or 32*b*.

Non-described reference numeral 37 is a noise-absorbing member which is provided in the pivot supporting member 31.

The operation and effect of the brush head 10 of the vacuum cleaner according to a preferred embodiment of the present invention will now be described hereinafter.

The brush head 10 of the vacuum cleaner is detachably coupled to the suction pipe 20 connected to a flexible hose (not shown) and sucks dust or dirt by means of a negative pressure caused by an operation of a vacuum pump (not shown).

Figure 5:
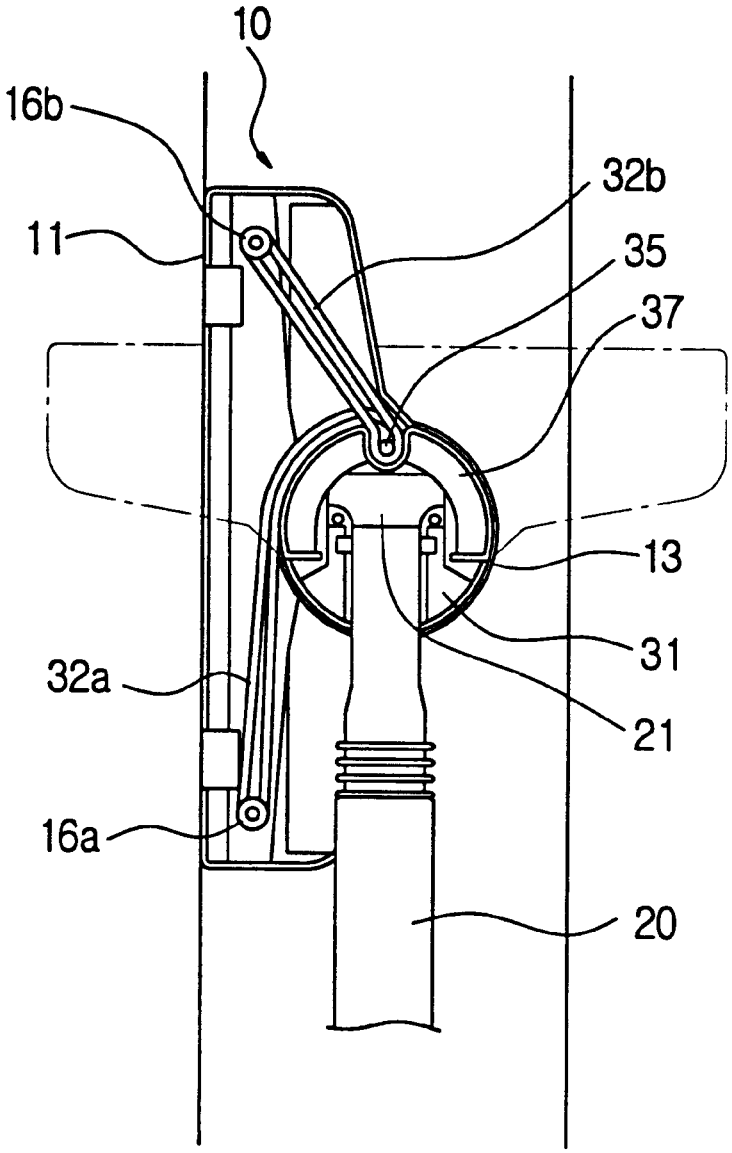
FIG. 5 is a plan view showing an operating state of the brush head depicted in FIG. 2.

Specially, in case of cleaning an area narrower than the width of the brush head 10, the brush head body 11 pivots to the left or right in close contact with a wall, etc., and enters the narrow area to perform a cleaning process. That is, as shown in FIG. 5, the pivoting part 13 which is integrally formed with the brush head body 11 pivots about the supporting shaft 14 with respect to the pivot supporting member 31 which is coupled to the suction pipe 20 by means of the connecting member 21. The inventive brush head 10 can pivot to the left or right by the angle of 90°.

Further, when the brush head 10 pivots to the left or right with respect to the suction pipe 20, one elastic band 32*a* (see FIG. 5) which is disposed in a pivoting direction, of two bands 32*a* and 32*b* caught on the supporting protuberances 16*a* and 16*b* and the fixing pin 35, is in an elongated state.

In the meantime, as described above, when the brush head 10 moves forward and backward such that the brush head 10 pivots by a predetermined angle with respect to the suction pipe 20, since the roller 34 is exposed downward through the roller receiving cut 15 of the pivoting part 13 and contacts constantly with the floor, the brush head 10 moves forward and backward smoothly, thus the cleaning process can be easily performed.

After cleaning the narrow area completely by the above operation, if the outer force applied to the brush head body 11 is eliminated, the brush head body 11 returns to its original position shown by an imaginary line in FIG. 5 by means of the elastic restoring force of the elongated elastic band 32*a* of the pair of bands 32*a* and 32*b* which elastically connect the brush head body 11 and the pivot supporting member 31, thereby the brush head body 11 being positioned perpendicular to the suction pipe 20 so as to perform an ordinary cleaning process.

Specially, since the brush head body 11 is pivotably coupled to the pivot supporting member 31 by means of the elastic bands 32*a* and 32*b* made from silicon resin material as described above, even when the bands 32*a* and 32*b* are used for a long term, the elastic force is constantly applied to both brush head body 11 and pivot supporting member 31, so the brush head body 11 returns to its original position accurately and is prevented from being tilted. As a result, the brush head 10 can be always disposed in a constant location with respect to the suction pipe 20.

Figure 6:
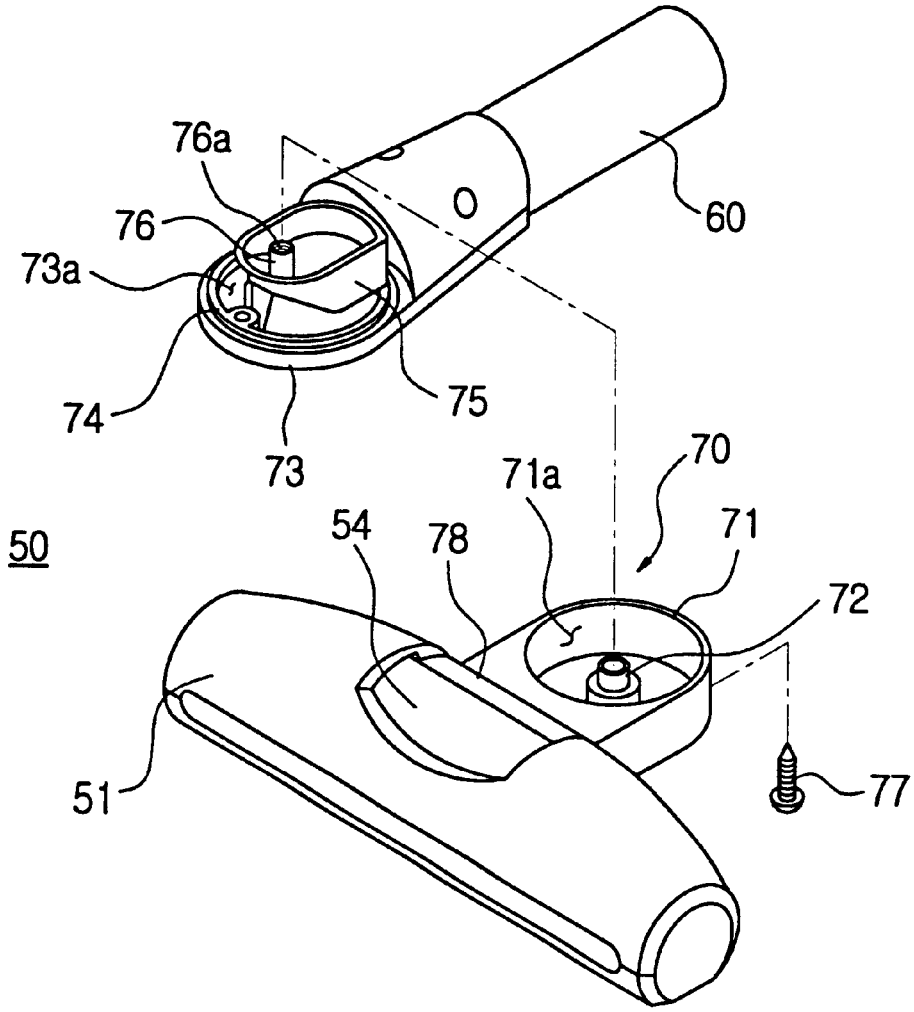
FIG. 6 is a partially exploded perspective view showing a brush head of a vacuum cleaner according to another preferred embodiment of the present invention.
Figure 7:
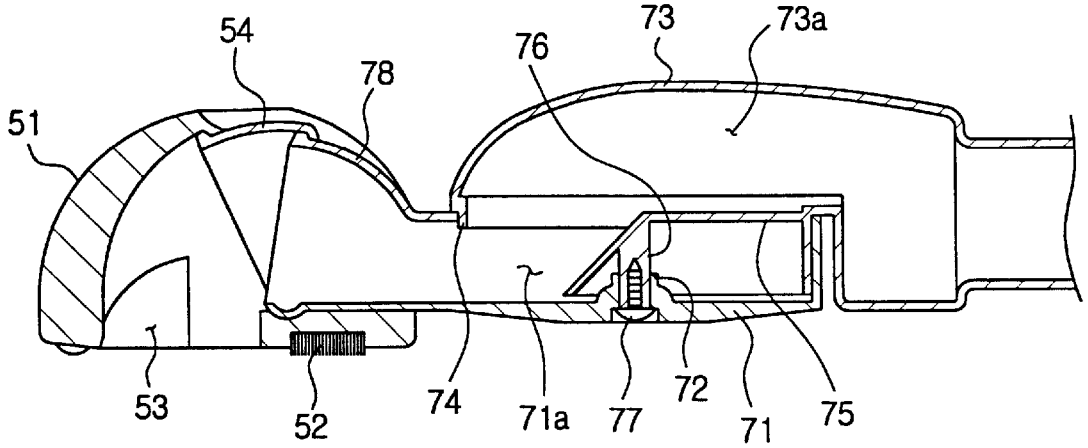
FIG. 7 is a sectional view showing the brush head depicted in FIG. 6.

FIG. 6 is a partially exploded perspective view showing a brush head of a vacuum cleaner according to another preferred embodiment of the present invention, and FIG. 7 is a sectional view showing the brush head depicted in FIG. 6.

As shown in the drawings, a brush head 50 of a vacuum cleaner according to another embodiment of the present invention comprises a body 51 forming an outer appearance, which is detachably coupled to a front end of a suction pipe 60, a brush 52 which is mounted to the body 51, and a pivoting device 70 which enables the brush head 50 to pivot in a horizontal direction with respect to the suction pipe 60.

At a bottom surface of the brush head body 51, a suction hole 53 for sucking dust or dirt is formed.

The pivoting device 70 includes a pivoting means that is implemented as a pivoting coupler 71 which is hingedly coupled to the brush head body 51 so as to pivot in a vertical direction and is disposed at a rear central portion of the body 51, a fixing means that is implemented as a fixing coupler 73 which is detachably coupled to a front end of the suction pipe 60 and is coupled to an upper portion of the pivoting coupler 71 for supporting the pivoting movement of the pivoting coupler 71, and a coupling means that is implemented as a hinge screw 77 which is fastened to the pivoting and fixing couplers 71 and 73 for coupling the m pivotably with respect to each other.

Describing more in detail, one end of the pivoting coupler 71 is disposed inside the brush head body 51 and is formed with a curved vertical pivoting part 78 so that the brush head body 51 can pivot in a vertical direction. The other end of the pivoting coupler 71 is disposed at a rear central portion of the brush head body 51 and is formed with a circular first air hole 71*a*. Inside the brush head body 51 is provided a curved guiding plate 54 which is formed correspondingly to the vertical pivoting part 78 of the pivoting coupler 71 and guides the vertical pivoting movement of the brush head body 51.

The first air hole 71*a* of the pivoting coupler 71 communicates with the suction hole 53 of the brush head body 51, and a hollow female holder 72 is disposed inside the first air hole 71*a* and protrudes upward from the central portion of a bottom surface of the pivoting coupler 71.

The fixing coupler 73 is detachably coupled to a front end of the suction pipe 60, and is formed with a circular second air hole 73*a* opposed to the first air hole 71*a*, the second air hole 73*a* being of equal size to the first air hole 71*a* and communicating with the suction pipe 60. A flange portion 74 is formed around the second air hole 73*a*, the flange portion 74 being inserted into the first air hole 71*a* while contacting with an inner peripheral wall of the first air hole 71*a*. And, the fixing coupler 73 is provided with a pivot supporting part 75 which is disposed lower than the flange portion 74. This pivot supporting part 75 is provided with a male holder 76 which protrudes downward from an upper surface of the pivot supporting part 75 and is inserted into the hollow female holder 72 formed in the first air hole 71*a*, the male holder 76 being formed with a screw hole 76*a* thereinside in a longitudinal direction. And, a part of the outer peripheral wall of the pivot supporting part 75 contacts with the inner peripheral wall of the first air hole 71*a*, so as to guide and support the pivoting movement of the pivoting coupler 71, which will be described later.

The female holder 72 of the pivoting coupler 71 and the male holder 76 of the fixing coupler 73 are pivotably coupled with respect to each other by the hinge screw 77 penetrating the bottom surface of the pivoting coupler 71 and fastened into the screw hole 76*a* of the male holder 76 which is inserted into the female holder 72.

The operation and effect of the brush head 50 of the vacuum cleaner according to another preferred embodiment of the present invention will now be described hereinafter.

The brush head 50 of the vacuum cleaner is detachably coupled to the suction pipe 60 connected to a flexible hose (not shown) and sucks dust or dirt by means of a negative pressure caused by an operation of a vacuum pump (not shown). The dust or dirt sucked through the suction hole 53 of the brush head 50 pass through the first air hole 71*a* of the pivoting coupler 71 and the second air hole 73*a* of the fixing coupler 73 in that order, and move inside the suction pipe 60.

Figure 8:
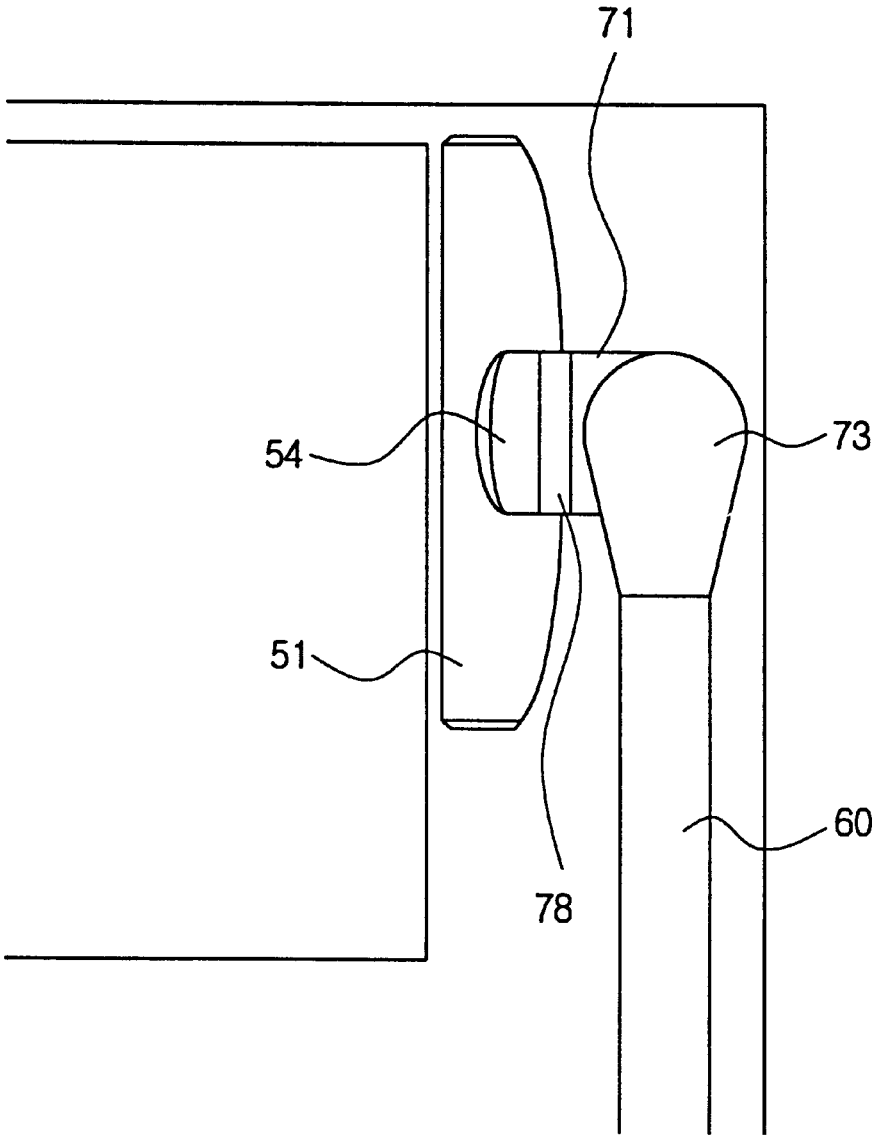
FIG. 8 is a plan view showing an operating state of the brush head depicted in FIG. 6.

Specially, if an area narrower than the width of the brush head 50 is cleaned, as shown in FIG. 8, the brush head body 51 pivots to the left or right in close contact with a wall, etc., and enters the narrow area to perform a cleaning process. That is, the pivoting coupler 71 fixed to the brush head body 51 pivots with respect to the fixing coupler 73 coupled to the suction pipe 60 about the hinge screw 77 which pivotably fastens the female holder 72 to the male holder 76, thereby the brush head body 51 pivoting to the left or right. Further, since the pivoting coupler 71 pivots whereby the inner peripheral wall of the first air hole 71*a* contacts with the flange portion 74 of the fixing coupler 73 and the pivot supporting part 75, the pivoting movement of the brush head body 51 can be performed stably and smoothly.

After cleaning the narrow area completely by the above operation, a user can return the brush head body 51 to its original position perpendicular to the suction pipe 60 for performing an ordinary cleaning process.

As described above in detail, the brush head of the vacuum cleaner according to the present invention can pivot in a horizontal direction as well as a vertical direction, thereby easily cleaning the area narrower than the width of the brush head.

Although various embodiments which incorporate the teachings of the present invention have been shown and described in detail herein, those skilled in the art can readily devise many other varied embodiments that still incorporate these teachings.

What is claimed is:

1. A brush head of a vacuum cleaner, comprising:

a body being detachably coupled to a suction pipe and being formed with a suction hole for sucking dust from a floor;

a fixing means for pivotally supporting the body, the fixing means including a cylindrical pivot-supporting member, in which an end of the fixing means is detachably coupled to the suction pipe, the pivot-supporting member is formed with a communicating space at a peripheral wall thereof, and is provided with a roller at its rear bottom surface, the pivot-supporting member communicates with the suction hole and the suction pipe, the fixing means including a fixing coupler, one end of which is detachably coupled to the suction pipe;

a pivoting means for pivoting the pivot-supporting member therein, an end of which is fixedly coupled to the body and another end of which is coupled to the other end of the fixing means pivotally in a horizontal direction, the pivoting means pivoting together with the body, the pivoting means including a pivoting part, in which the pivoting part is integrally formed with the body at a rear central portion of the body, the pivot-supporting member is inserted into a roller receiving cut so that it is pivotally moved along the roller receivng cut; and a coupling means for elastically supporting the connection between the body and the pivoting means, the coupling means being mounted to the fixing means and the pivoting means so as to support securely the connection there between, the coupling means including a pair of elastic members, in which an end of each elastic member is fixed at the pivot-supporting member and an other end of each elastic member is fixed at the body, the pair of elastic members are disposed symmetrically on both sides of the body, wherein a supporting shaft which is inserted into the pivot-supporting member to support the pivoting movement of the pivoting part protrudes upward from a central portion of a lower surface of the pivoting part, the roller receiving cut, which receives the roller, is formed along a periphery of the lower surface of the pivoting part, through which the roller can contact continuously with the floor.

2. The brush head of a vacuum cleaner as claimed in claim 1, wherein the roller receiving cut is formed at a circumferential angle of 180° at a rear lower surface of the pivoting part.

3. The brush head of a vacuum cleaner as claimed in claim 1, wherein the end of each elastic member is fixed at the pivot-supporting member by means of a fixing pin being perpendicularly inserted in the pivot-supporting member at a front upper portion thereof, in which an upper end of the fixing pin is upwardly exposed to the outside of the pivot-supporting member, wherein a pair of supporting protuberances protrude upward symmetrically at the body, adjacently to each lateral end of the body, on which the other end of each elastic member is fixed respectively.

4. The brush head of a vacuum cleaner as claimed in claim 3, wherein the elastic member is an elastic band which is made from a silicon resin material.

5. The brush head of a vacuum cleaner as claimed in claim 1, wherein between the suction pipe and the pivot-supporting member are provided a connecting member, one end of which is detachably coupled to the suction pipe and the other end of which is hingedly coupled to the pivot-supporting member, and the connecting member is provided with a pair of pivot shafts which protrude from both sides of the connecting member respectively so that the body can pivot in a vertical direction with respect to the suction pipe.

6. The brush head of a vacuum cleaner as claimed in claim 5, wherein a cover is coupled to an upper portion of the pivoting part for shielding the pivot-supporting member, and a vertical cut is formed at the rear portion of the cover through which the connecting member passes, when the suction pipe is pivoted in a vertical direction with respect to the body.

7. A brush head of a vacuum cleaner, comprising:

a body being detachably coupled to a suction pipe and being formed with a suction hole for sucking dust from a floor;

a fixing means for pivotally supporting the body, the fixing means including a cylindrical pivot-supporting member, in which an end of the fixing means is detachably coupled to the suction pipe, the pivot-supporting member is formed with a communicating space at a peripheral wall thereof, and is provided with a roller at its rear bottom surface, the pivot-supporting member communicates with the suction hole and the suction pipe, the fixing means including a fixing coupler, one end of which is detachably coupled to the suction pipe;

a pivoting means for pivoting the pivot-supporting member therein, an end of which is fixedly coupled to the body and an other end of which is coupled to the other end of the fixing means pivotally in a horizontal direction, the pivoting means pivoting together with the body, the pivoting moans including a pivoting part, in which the pivoting part is integrally formed with the body at a rear central portion of the body, the pivot-supporting member is inserted into a roller receiving cut so that it is pivotally moved along the roller receiving cut; the pivoting means including a pivoting coupler which is coupled at one end to the body pivotally in a vertical direction at a rear central portion of the body and at another end to the fixing coupler, and a coupling means for supporting the connection between the body and the pivoting means, the coupling means being mounted to the fixing means and the pivoting means so as to support securely the connection therebetween, the coupling means including a hinge screw which is fastened to the pivoting and fixing couplers so that the pivoting coupler can pivot in a horizontal direction with respect to the fixing coupler;

wherein a supporting shaft which is inserted into the pivot-supporting member to support the pivoting movement of the pivoting part protrudes upward from a central portion of a lower surface of the pivoting part, the roller receiving out, which receives the roller, is formed along a periphery of the lower surface of the pivoting part, through which the roller can contact continuously with the floor.

8. The brush head of a vacuum cleaner as claimed in claim 7, wherein one end of the pivoting coupler is disposed inside the body and is formed with a curved vertical pivoting part so that the body can pivot in a vertical direction, the other end of the pivoting coupler is disposed at a rear central portion of the body and is formed with a circular first air hole which communicates with the suction hole, and a hollow female holder protrudes upward from the central portion of a bottom surface of the first air hole.

9. The brush head of a vacuum cleaner as claimed in claim 8, wherein the fixing coupler includes a circular second air hole which is of equal size and formed opposed to the first air hole, the second air hole communicating with the suction pipe, a pivot-supporting part which is disposed lower than the second air hole and received in the first air hole when the fixing coupler is coupled to the pivoting coupler, and a male holder which protrudes downward from an upper surface of the pivot-supporting part formed at an end portion of the suction pipe and is inserted into the hollow female holder formed in the first air hole, the male holder being formed with a screw hole there inside in a longitudinal direction, wherein the hinge screw penetrates the bottom surface of the pivoting coupler and is fastened into the screw hole of the male holder which is inserted into the female holder.

10. A brush head of a vacuum cleaner, comprising:

a body being detachably coupled to a suction pipe and being formed with a suction hole for sucking dust from a surface of a floor;

a hollow cylindrical pivoting part which is integrally formed with the body at a rear central portion of the body and is formed with a roller receiving cut along a periphery of a lower surface of the pivoting part;

a cylindrical pivot-supporting member which is inserted into the pivoting part to support a horizontal pivoting movement of the pivoting part, the pivot-supporting member being formed with a communicating space at its peripheral wall which communicates with the suction hole and the suction pipe, and being provided with a roller at its rear bottom surface, and a pair of elastic bands, one end of each elastic band being fixed to the pivot-supporting member and the other end of each elastic band being fixed to the body, the pair of elastic bands being disposed symmetrically on both sides of the body, in which an end of the suction pipe is pivotally inserted into an interior of the pivoting supporting member when a cover and the pivot-supporting member are engaged with each other.

11. The brush head of a vacuum cleaner as claimed in claim 10, wherein the end of each elastic band is fixed at the pivot-supporting member by means of a fixing pin being perpendicularly inserted in the pivot-supporting member at a front upper portion thereof, in which an upper end of the fixing pin is upwardly exposed to the outside of the pivot-supporting member, wherein a pair of supporting protuberances protrude upward symmetrically at the body, adjacently to each lateral end of the body, on which the other end of each elastic band is fixed respectively.

12. The brush head of a vacuum cleaner as claimed in claim 10, wherein between the suction pipe and the pivot-supporting member are provided a connecting member, one end of which is detachably coupled to the suction pipe and the other end of which is hingedly coupled to the pivot-supporting member, and the connecting member is provided with a pair of pivot shafts which protrude from both sides of the connecting member respectively so that the body can pivot in a vertical direction with respect to the suction pipe.

13. The brush head of a vacuum cleaner as claimed in claim 12, wherein the cover is coupled to the upper portion of the pivoting part for shielding the pivot-supporting member, and a vertical cut is formed at the rear portion of the cover through which the connecting member passes, when the suction pipe is pivoted in a vertical direction with respect to the body.

14. A brush head of a vacuum cleaner, comprising:

a body being detachably coupled to a suction pipe and being formed with a suction hole for sucking dust from a surface of a floor;

a pivoting coupler, one end of which is disposed inside the body and is formed with a curved vertical pivoting part so that the body can pivot in a vertical direction, and the other end of which extends rearwardly from a rear central portion of the body and is formed as a first cylindrical air chamber communicating with the suction hole;

a fixing coupler, one end of which is detachably coupled to the suction pipe and the other end of which is coupled to the pivoting coupler, the fixing coupler including a second cylindrical air chamber and a pivot-supporting part in which the second cylindrical air chamber is of equal size and formed opposed to the first cylindrical air chamber and the pivot-supporting part extends downwardly from the second cylindrical air chamber and received in the first cylindrical air chamber when the fixing coupler is coupled to the pivoting coupler, the second cylindrical air chamber communicating with the suction pipe; and a hinge screw is fastened to the pivoting and fixing couplers so that the pivoting coupler can pivot in a horizontal direction with respect to the fixing coupler.

15. The brush head of a vacuum cleaner as claimed in claim 14, wherein a hollow female holder is disposed inside the first cylindrical air chamber and protrudes upward from the central portion of a bottom surface of the pivoting coupler, a male holder protrudes downward from an upper surface of the pivot-supporting part, formed at an end portion of the suction pipe and is inserted into the hollow female holder formed in the first cylindrical air chamber, the male holder being formed with a screw hole there inside in a longitudinal direction, and the hinge screw penetrates the bottom surface of the pivoting coupler and is fastened into the screw hole of the male holder which is inserted into the female holder.

* * * * *